US005662494A

United States Patent [19]

Zennamo, Jr. et al.

[11] Patent Number: 5,662,494

[45] Date of Patent: Sep. 2, 1997

[54] FILTER STRUCTURE WITH SELF-SEALING COLLET ASSEMBLY

[75] Inventors: Joseph A. Zennamo, Jr., Skaneateles; Joseph N. Maguire, Syracuse, both of N.Y.

[73] Assignee: Eagle Comtronics, Inc., Syracuse, N.Y.

[21] Appl. No.: 416,637

[22] Filed: Apr. 5, 1995

Related U.S. Application Data

[63] Continuation-in-part of Ser. No. 155,135, Nov. 22, 1993, abandoned.

[51] Int. Cl.[6] ..... H01R 13/40

[52] U.S. Cl. ..... 439/589

[58] Field of Search ..... 439/271, 936, 439/587, 589; 333/175

[56] References Cited

U.S. PATENT DOCUMENTS

| | | | |
|---|---|---|---|
| 2,695,390 | 11/1954 | Woolston et al. | 439/589 |
| 4,857,006 | 8/1989 | Linyeav et al. | 439/271 |
| 4,901,043 | 2/1990 | Palinkas | 333/175 |
| 4,973,268 | 11/1990 | Smith et al. | 439/589 |
| 4,976,634 | 12/1990 | Green et al. | 439/936 |
| 5,168,251 | 12/1992 | Zennamo, Jr. et al. | 333/175 |
| 5,263,873 | 11/1993 | Landries | 439/271 |

*Primary Examiner*—Gary F. Paumen
*Attorney, Agent, or Firm*—Parkhurst, Wendel & Burr, L.L.P.

[57] ABSTRACT

A filter structure including a collet assembly of inexpensive design that provides a reliable seal and can be easily implemented during the manufacturing process is disclosed. The collet assembly includes a front cap, a rear insert body, a collet contact extension passing through the rear insert body, and a seal located between the front cap and the rear insert body. The collet assembly is inserted into a connector of a filter housing. The seal provides a seal between the interface of the filter housing and the collet assembly. The collet assembly also preferably includes a well in the rear insert body that is filled with a sealant material that seals the interface between the rear insert body and the collet contact extension.

4 Claims, 8 Drawing Sheets

FILTER STRUCTURE WITH SELF-SEALING COLLET ASSEMBLY

CROSS REFERENCE TO RELATED APPLICATIONS

The present application is a continuation-in-part of, and claims priority from, U.S. application Ser. No. 08/155,135, filed Nov. 22, 1993, now abandoned, benefit from which under 35 U.S.C. § 120 is hereby claimed.

FIELD OF THE INVENTION

The invention relates to electrical signal filters that are used to decode or unscramble protected television signals in order to permit their reception and also to attenuate/remove portions of the signals to prevent their reception. More specifically, the invention relates to an improved filter structure that provides a sealed collet assembly to prevent moisture and/or other contaminants from entering the filter.

BACKGROUND

Tuned filters have been employed for a number of years to decode scrambled or protected television signals. U.S. Pat. No. 5,168,251 discloses a notch filter, for example, that includes two separate electrically interconnected filter sections mounted on a common circuit board. Connections to the filter sections provided on the circuit board are made via a collet assembly and a terminal that are soldered to the circuit board. The two filter sections are magnetically isolated through an isolation area defined by an isolation shield. The common circuit board is placed within a filter housing having one open end and an integral connector located at the other end. Art end cap is then attached to the open end of the filter housing with a press fit. The filter housing with attached end cap is then located within an outer sleeve by sliding the filter housing into an open end of the outer sleeve. A press-fit is commonly used as the securing mechanism to retain the filter housing within the outer sleeve.

It is important to seal the filter structure to prevent moisture and other contaminants from entering the filter. One particularly difficult area to properly seal is the interface between the collet and the filter housing. Conventional manufacturing techniques attempt to utilize relatively large amounts of sealant to cover over the entire back portion of the collet. This method, however, is somewhat difficult to work with and can result in inconsistencies in the quality of the manufactured filters. It would therefore be desirable to provide a collet assembly that could be quickly and easily sealed during the manufacturing process.

SUMMARY OF THE INVENTION

The invention provides a filter structure including a collet assembly of inexpensive design that provides a reliable seal and can be easily implemented during the manufacturing process. The collet assembly includes a front cap, a rear insert body, a collet contact extension passing through the rear insert body, and a seal located between the front cap and the rear insert body. The collet assembly is inserted into a connector of a filter housing. The seal provides a seal between the interface of the filter housing and the collet assembly. The collet assembly also preferably includes a well in the rear insert body that is filled with a sealant material (for example epoxy) that seals the interface between the rear insert body and the collet contact extension.

BRIEF DESCRIPTION OF THE DRAWINGS

The invention will be described in greater detail with reference to the accompanying drawings, wherein.

DETAILED DESCRIPTION OF THE PREFERRED EMBODIMENT

Figure 1:
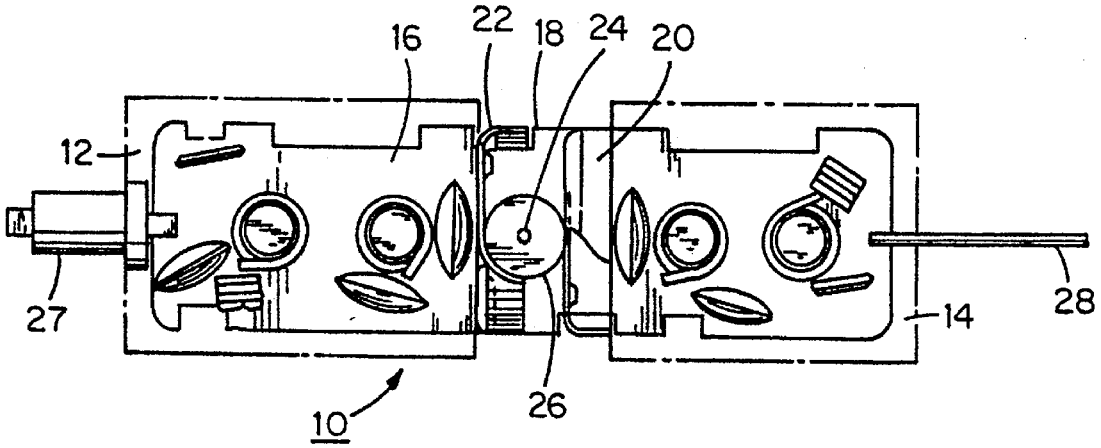
FIG. 1 is a top plan view of a notch filter circuit board assembly.

A top plan view of a notch filter circuit board assembly is illustrated in FIG. 1. The circuit board assembly 10 includes first and second filter sections 12, 14 commonly provided on a single circuit board 16. The first and second filter sections 12, 14 are separated by an isolation area 18, which is defined by two isolation shields 20, 22 that project both above and below the upper and lower surface of the circuit board 10. A conductor within the isolation area 18 (not shown), which interconnects the first and second filter sections 12, 14, runs along part of its course substantially parallel to and midway between the isolation shields 20, 22. A test point 24 is connected to the conductor to project upwardly from the component mounting surface of the circuit board 16 and between the isolation shields 20, 22. A sleeve 26, also located between the isolation shields 20, 22, prevents the test point 24 from contacting electrical ground. The isolation shields 20, 22 are connected to ground, and serve to provide magnetic isolation between the first and second filter sections 12, 14 by preventing any magnetic fields from one filter section from affecting the other filter section. Electrical connection is respectively provided to the first and second filter sections 12, 14 via a collet assembly 27 and input terminal 28. A more detailed explanation of the illustrated circuit board assembly is provided in U.S. Pat. No. 4,451,803, the contents of which are herein incorporated by reference.

Figure 2:
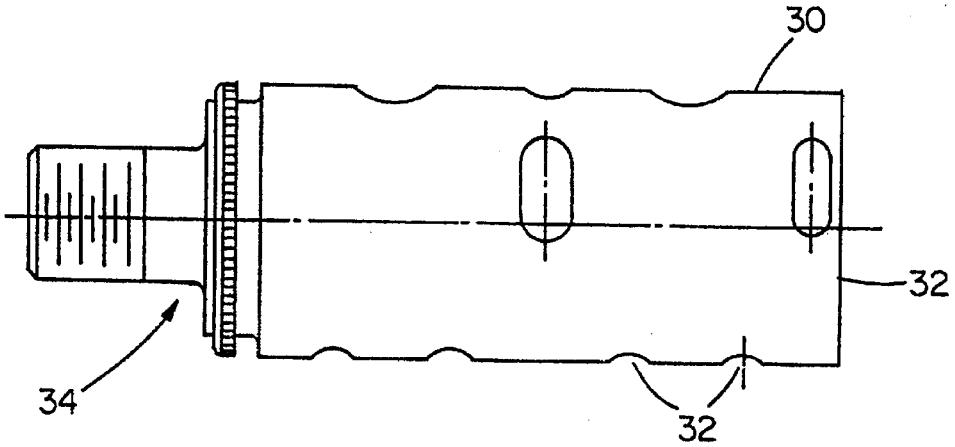
FIG. 2 illustrates a filter housing.

The circuit board assembly 10 is incorporated within a cylindrical or tube-like filter housing 30 of the type illustrated in FIG. 2. The filter housing 30 preferably includes holes 32, which allow access to tuning slugs within the various inductor coils employed in the circuit board assembly 10, an open end 32, and an end having an integral threaded connector 34. The open end 32 of the filter housing 30 is closed by an end cap that is press-fit therein once the circuit board assembly 10 has been placed within the filter housing 30. Specifically, the outer periphery of the end cap is press-fit within the inner periphery of the filter housing 30.

Figure 3:
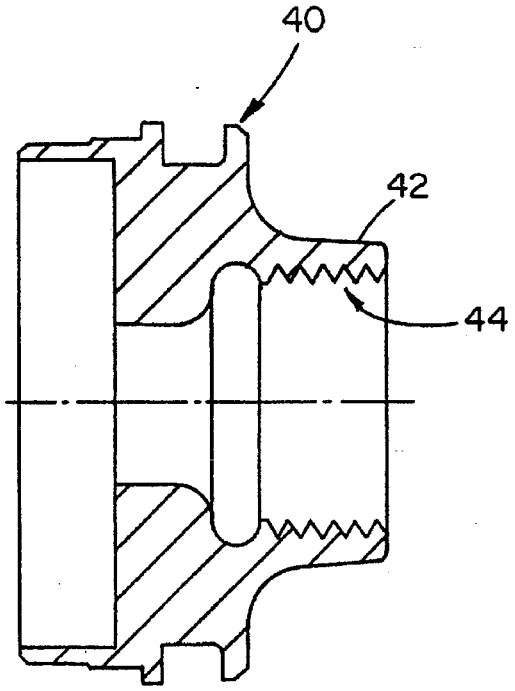
FIG. 3 is a sectional side view of an end cap that attaches to the filter housing shown in FIG. 2.

FIG. 3 illustrates a side view of an end cap 40 which includes a connector portion 42 having an internal screw threaded bore 44 for connection with an external cable. The input terminal 28 of the circuit board assembly 10 passes through the threaded bore 44 when the end cap 40 is press-fit into the open end of the filter housing 30. The outside surface of the connector portion 42 is circular.

Figure 4:
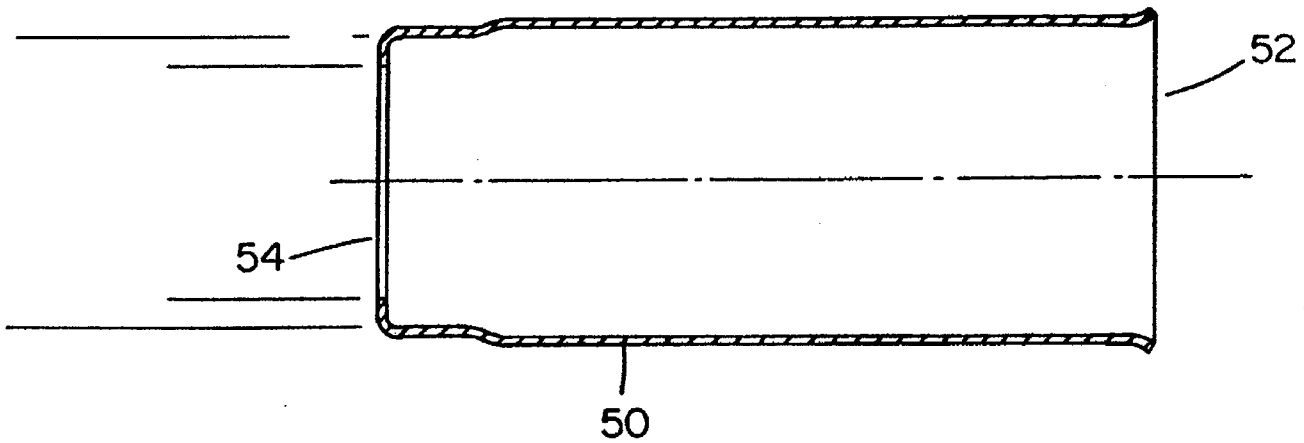
FIG. 4 PRIOR ART
FIG. 4 is a sectional side view of an outer sleeve.
Figure 5:
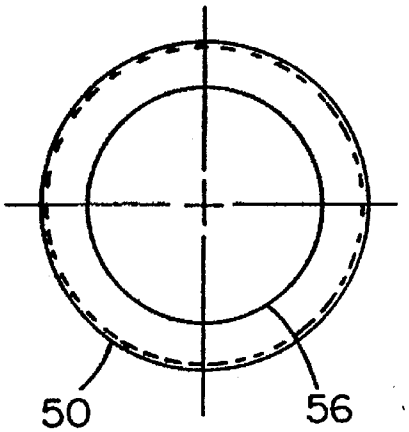
FIG. 5 PRIOR ART
FIG. 5 is a front view of the outer sleeve shown in FIG. 4.

The combined filter housing 30 and conventional end cap 40 are placed within an outer sleeve 30 of the type shown in FIGS. 4 and 5. A first end 32 of the outer sleeve 50 is completely open to allow the combined filter housing 30 and end cap 40 to slide therein. A second retaining end 54 of the outer sleeve 50, however, has a retainer opening 56 through which only the connector portion 42 of the end cap 40 can pass. As shown in FIG. 5, retainer opening 56 is circular to match the circular shape of the connector portion 42 of the end cap 40. A crimping operation is applied to the open end 52 of the outer sleeve 50 to form a press-fit with the integral threaded connector 34 of the filter housing 30.

Figure 6:
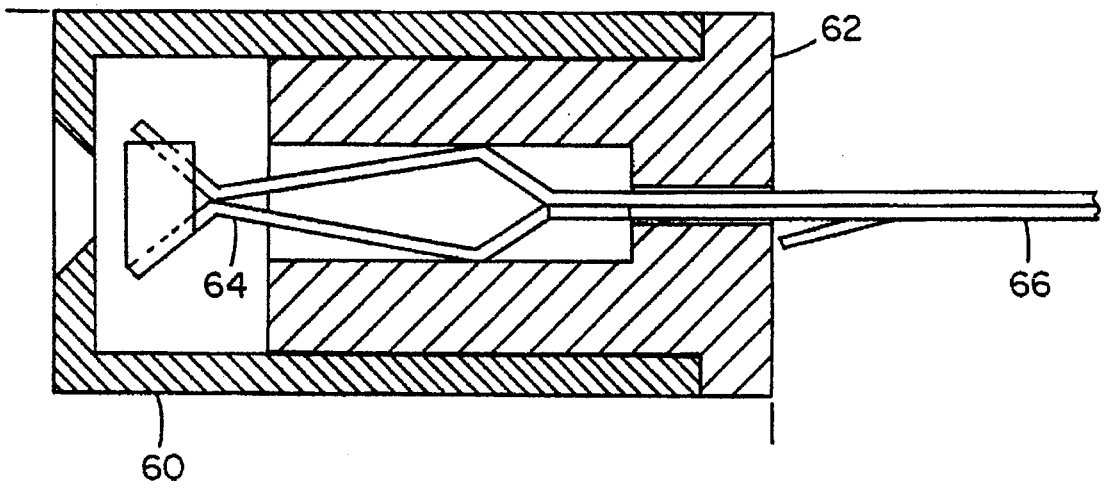
FIG. 6 PRIOR ART
FIG. 6 illustrates a conventional collet assembly.
Figure 10:
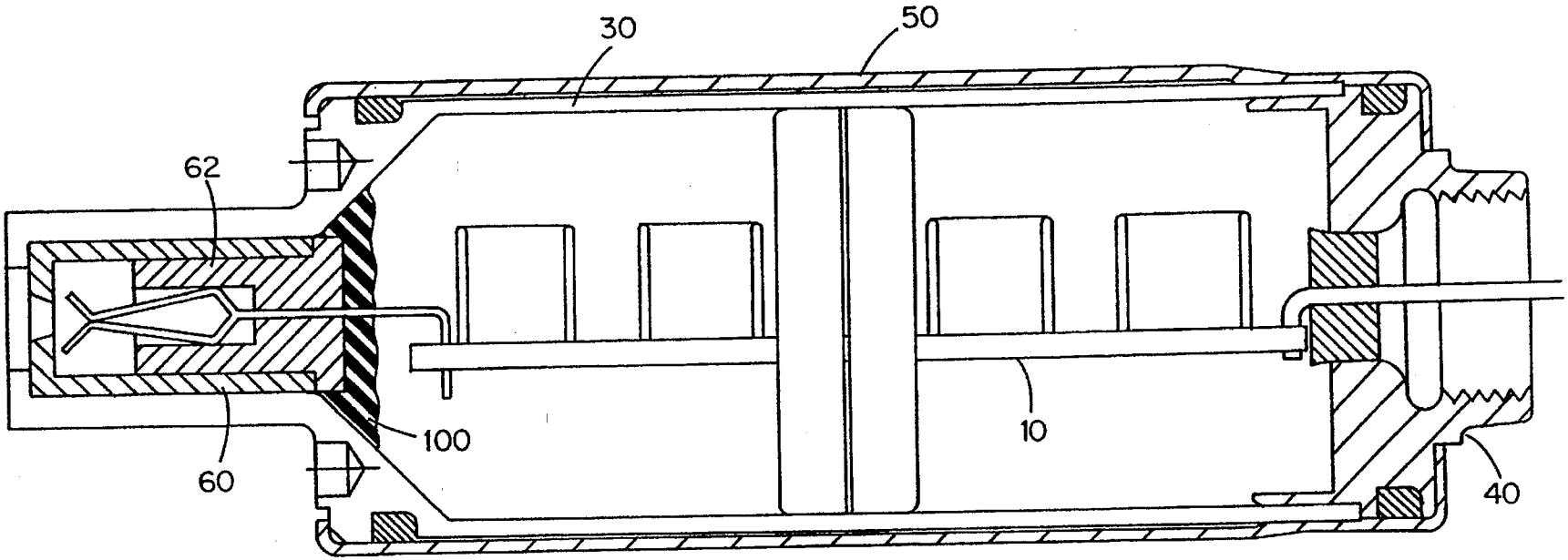
FIG. 10 PRIOR ART
FIG. 10 is a sectional side of a completed filter assembly according to the prior art.

A conventional collet assembly is shown in greater detail in FIG. 6. The collet assembly includes a front cap 60 that slides onto a rear insert body 62. A collet contact extension 64 is inserted within the rear insert body 62, and has an end 66 that is soldered to the circuit board 16. During assembly of the filter structure, the collet assembly slides into the integral threaded connector 32 of the filter housing 30. Epoxy sealant 100 is then placed over the entire rear portion of the rear insert body 62 in an attempt to prevent leakage from around the interface between the collet assembly and the filter housing 30 and the interface between the collet contact extension 64 and the rear insert body 62, as shown in FIG. 10. The sealing operation is difficult to perform, however, due to the limited amount of available work space, namely, the epoxy sealant 100 must be passed blindly through a partial length of the filter housing 30 through a side opening formed therein.

Figure 7:
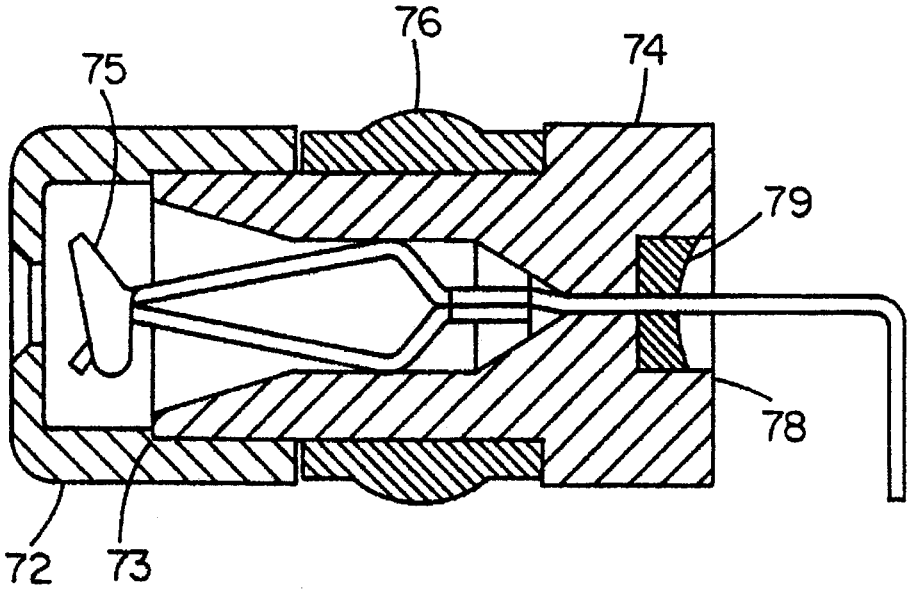
FIG. 7 illustrates a collet assembly in accordance with a first embodiment of the invention.
Figure 9:
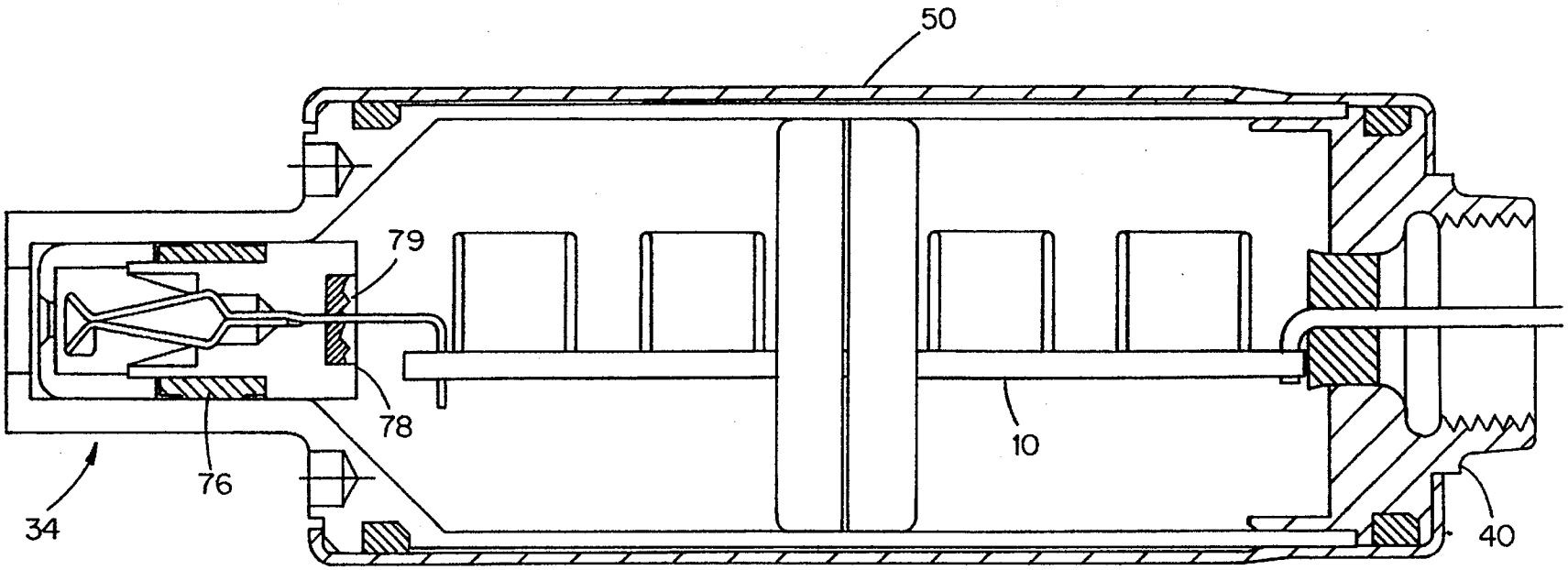
FIG. 9 is a sectional side view of a completed filter assembly.

Referring now to FIG. 7, a collet assembly 70 in accordance with a first embodiment of the invention is shown including a front cap 72 that slides over a portion of a rear insert body 74 until it is properly located by a stop 73. As with the conventional structure shown in FIG. 6, a collet contact extension 75 is inserted through the rear insert body 74. The collet assembly 70, however, further includes an elongated surface compression seal 76 (made of rubber or any suitable elastomer material) located between the front cap 72 and the rear insert body 74. The stop 73 is preferably located to insure a clearance space between the front cap 72 and the compression seal 76. The compression seal 76 is slightly larger than the inner diameter of a hole provided in the integral threaded connector 74, such that the compression seal 76 contacts an inner surface of the integral threaded connector 74 (as shown in FIG. 9) when the collet assembly 70 is inserted into the integral threaded connector 32 of the filter housing 30, thereby sealing the interface between the collect assembly 70 and the integral threaded connector 74. The rear insert body 74 is also provided with a small well 78 that is filled with sealant 79 to seal the interface between the collet contact extension 75 and the rear insert body 74.

The collet assembly 70 provides a distinct advantage over conventional collet assemblies, as the assembly of the compression seal 76 and the filling of the well 78 can be implemented as part of the manufacturing process of the circuit board assembly. No further sealing operation is required when the circuit board assembly is inserted within the filter housing, as the collet assembly effectively self-seals the interface between the collet assembly and the rear insert body 74, and the sealing of the collet contact extension has already been accomplished (when it is much easier to access) when building the circuit board assembly. In addition, the filter can be easily disassembled and pieces reused, including the seal, if a problem should arise during the manufacturing process.

Figure 8:
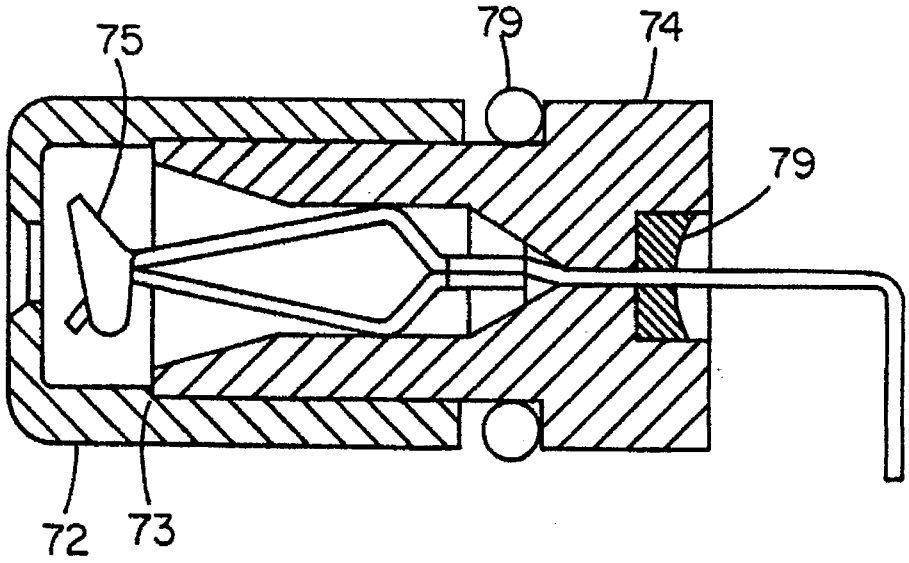
FIG. 8 illustrates a collet assembly in accordance with a second embodiment of the invention.

Referring now to FIG. 8, a second embodiment of the invention is shown in which the elongated surface compression seal 76 is replaced with an O-ring seal 79. The second embodiment is identical to the first embodiment in all other respects.

Figure 11:
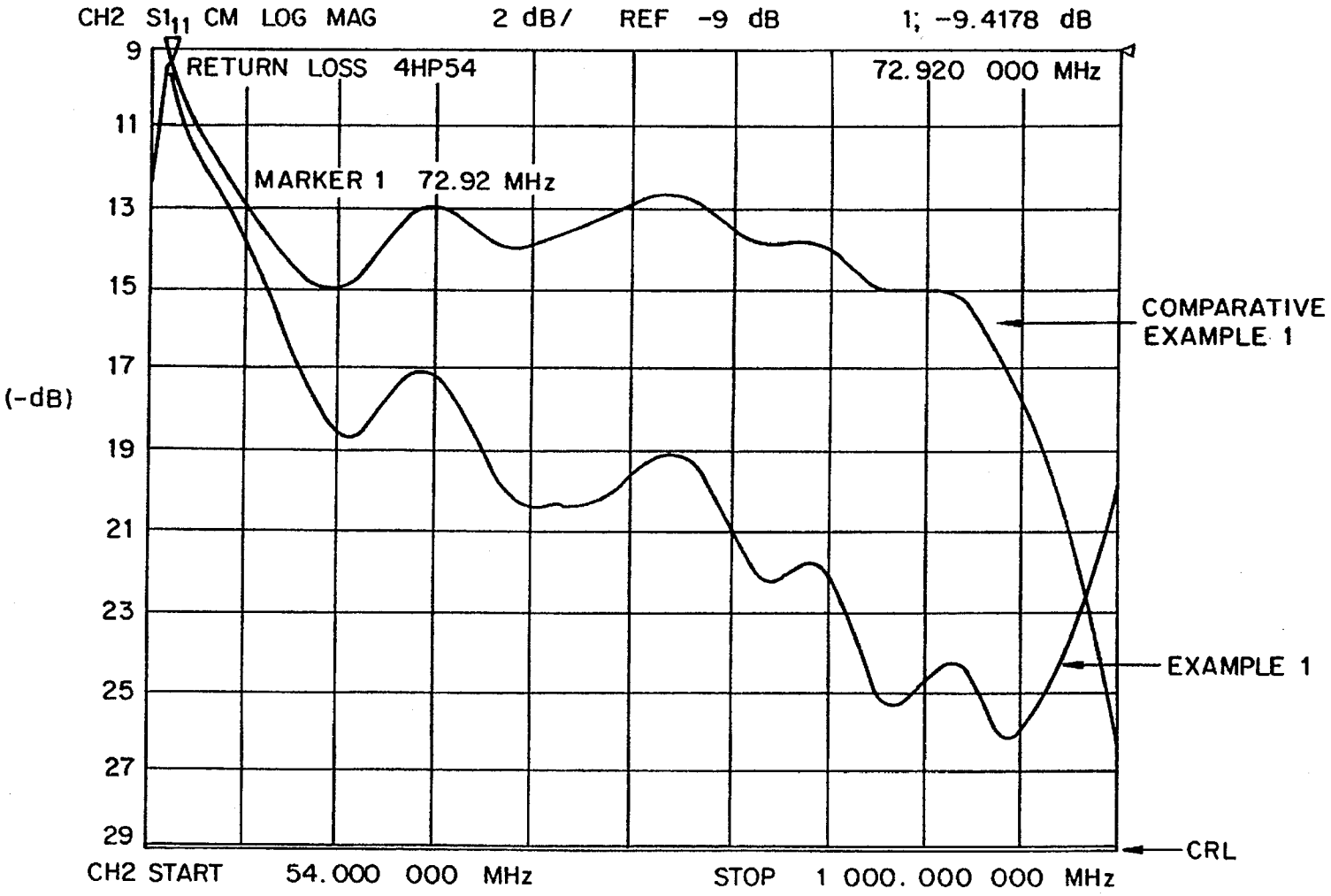
FIGS. 11 and 12 compare electrical characteristics of an embodiment of the presently claimed invention with the prior art.
Figure 12:
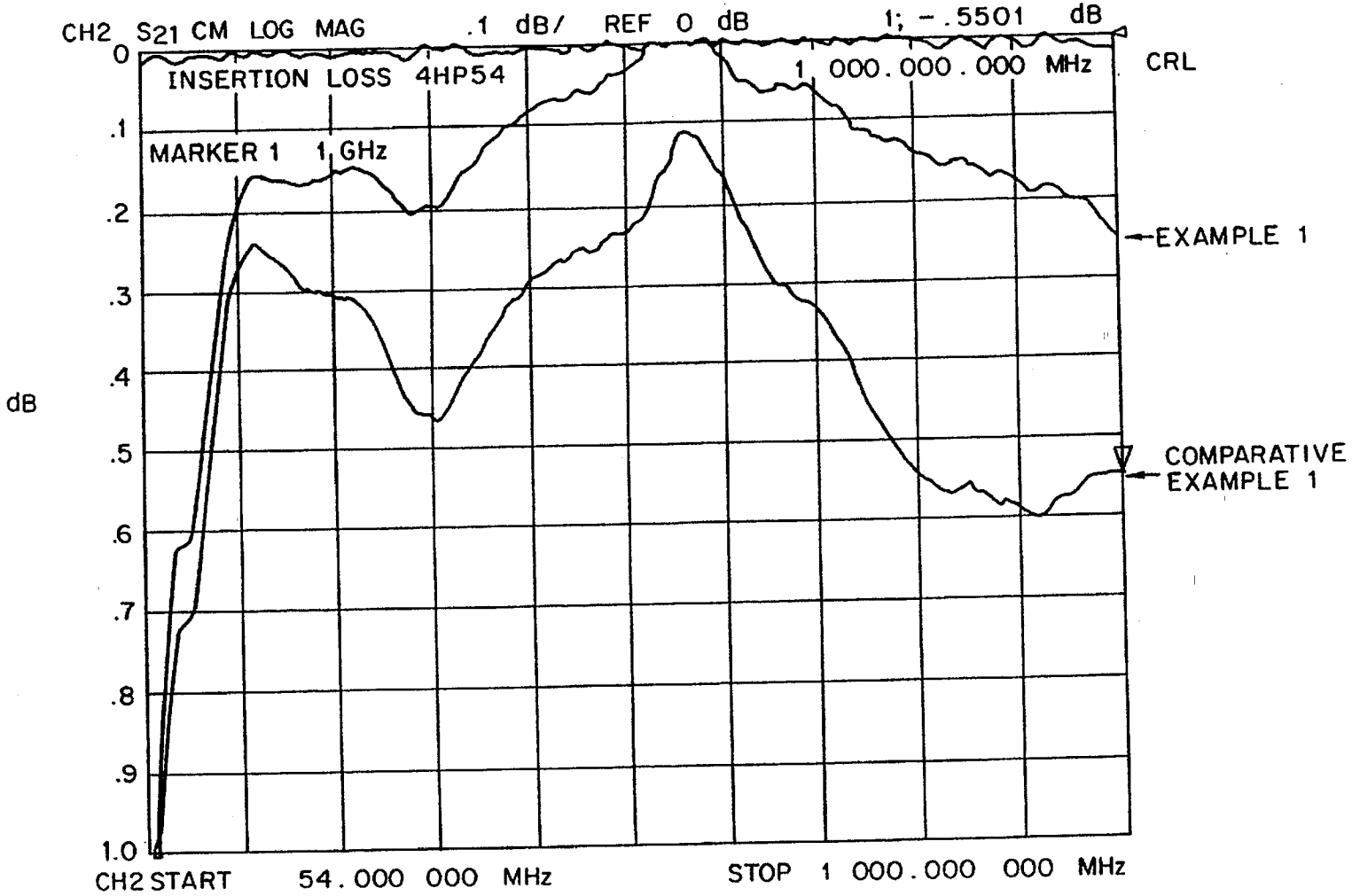

FIGS. 11 and 12 compare electrical response characteristics of Example 1, corresponding to an embodiment of the presently claimed invention as shown in FIG. 9, with Comparative Example 1, a prior art embodiment as shown in FIG. 10 of the present application. An HP8753B Network Analyzer was utilized to measure return loss and insertion loss of Example 1 and Comparative Example 1. The signals shown in FIGS. 11 and 12 were measured over a frequency range of 54 to 1,000 MHz. Calibrated reference lines (CRL's) are provided at −29 dB (indicating a desirably high return loss) and at 0 dB (indicating 100% signal strength) in FIGS. 11 and 12, respectively.

As shown in FIG. 11, the return loss for Example 1 is clearly significantly superior to that of Comparative Example 1 over the measured frequency range. Example 1 demonstrated a much higher return loss and more closely approached the calibrated reference line. Return loss indicates the impedance matching of the filter and collet assembly with its load (e.g., cable T.V. system). A poor impedance match translates into a snowy and ghosty picture from power loss and reflective waves, respectively.

Similarly, as shown in FIG. 12, Example 1 exhibited clearly superior insertion loss with respect to Comparative Example 1 over the measured frequency range of 54 to 1,000 MHz approaching the calibrated reference line, 0 dB.

Thus, in addition to advantages such as superior environmental seal, ease of assembly, ease of repair, etc., the presently claimed invention exhibits clearly superior electrical response characteristics with respect to the prior art. The improved electrical characteristics can be explained by considering the dielectric constant of the epoxy seal of the prior art, which has a relatively high dielectric constant relative to air (i.e., 3.5 to 5). It has been found that leakage of the epoxy seal of the prior art impairs the desired impedance match, insertion loss and bandwidth (frequency response) of the filter, which is solved by the presently claimed invention.

The invention has been described with reference to a preferred embodiment thereof. It will be understood, however, that modifications and variations are possible within the scope of the appended claims.

What is claimed is:

1. A filter structure comprising: a circuit board assembly including a collet assembly comprising a front cap, a rear insert body including a rear end portion, a collet contact extension passing through the rear insert body, and a seal located between the front cap and the rear insert body; a filter housing including at least one open end and a connector coupled to a second end, wherein the circuit board assembly is placed within the filter housing such that the collet assembly is located within the connector; wherein the seal of the collet assembly seals an interface between the collet assembly and the connector, and a region of the housing that surrounds the rear end portion is not covered by sealant material.

2. A filter structure as claimed in claim 1, wherein the rear insert body includes a well through which the collet contact extension passes, said well being filled with a sealant material that seals the interface between the rear body insert and the collet contact extension.

3. A filter structure as claimed in claim 1, further comprising an end cap including a connector portion, wherein the end cap is attached to the open end of the filter housing.

4. A filter structure as claimed in claim 3, further comprising an outer sleeve including an open end and a receiving end, wherein the filter housing, with the circuit board assembly located therein and the end cap attached thereto, is located within the outer sleeve via the open end thereof, such that the connector portion of the end cap passes through an opening in the receiving end.

* * * * *